US009752267B2

(12) United States Patent
Lee et al.

(10) Patent No.: US 9,752,267 B2
(45) Date of Patent: Sep. 5, 2017

(54) LAUNDRY TREATING APPARATUS

(71) Applicant: LG ELECTRONICS INC., Seoul (KR)

(72) Inventors: Dongsoo Lee, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 357 days.

(21) Appl. No.: 14/471,597

(22) Filed: Aug. 28, 2014

(65) Prior Publication Data

US 2015/0059418 A1 Mar. 5, 2015

(30) Foreign Application Priority Data

Aug. 28, 2013 (KR) ..... 10-2013-0102241

(51) Int. Cl.

| | |
|---|---|
| ***D06F 39/02*** | (2006.01) |
| ***D06F 39/08*** | (2006.01) |
| ***D06F 29/00*** | (2006.01) |
| ***D06F 37/26*** | (2006.01) |
| ***D06F 23/04*** | (2006.01) |

(52) U.S. Cl.

CPC ..... *D06F 37/267* (2013.01); *D06F 23/04* (2013.01); *D06F 29/00* (2013.01); *D06F 39/02* (2013.01); *D06F 39/085* (2013.01); *D06F 39/088* (2013.01)

(58) Field of Classification Search

CPC ..... D06F 37/267; D06F 23/04; D06F 29/00; D06F 39/02; D06F 39/085; D06F 39/088

USPC ..... 68/17 R

See application file for complete search history.

(56) References Cited

U.S. PATENT DOCUMENTS 5,675,994 A 10/1997 Gweon
2004/0107740 A1* 6/2004 Kim et al. ..... D06F 39/088 68/17 R (Continued)

FOREIGN PATENT DOCUMENTS

CN 1516764 A 7/2004
CN 1536133 A * 10/2004

(Continued)

OTHER PUBLICATIONS

Chinese Office Action for Application 201410432995.9 dated Jan. 4, 2016 (full Chinese text and full English translation).

(Continued)

*Primary Examiner* — Michael Barr
*Assistant Examiner* — Tinsae Ayalew
(74) *Attorney, Agent, or Firm* — Ked & Associates, LLP

(57) ABSTRACT

A laundry treating apparatus may include a cabinet detachably provided on a first treating apparatus exhibiting a laundry treating apparatus and forming an external appearance of the laundry treating apparatus. A drawer may be provided to be withdrawn from the cabinet and an input hole may be formed thereon. A tub provided within the drawer body may store wash water. A detergent supply unit may be provided to be withdrawn from the drawer body toward a center of the input hole and provide a space for storing detergent. A water supply unit may supply wash water to the detergent supply unit to supply the detergent stored in the detergent supply unit to the tub body.

18 Claims, 10 Drawing Sheets

(56) References Cited

U.S. PATENT DOCUMENTS

| | | | | |
|---|---|---|---|---|
| 2004/0172770 | A1* | 9/2004 | Heo | D06F 39/02 8/158 |
| 2009/0145174 | A1 | 6/2009 | Kim et al. | |
| 2010/0018258 | A1 | 1/2010 | Cho et al. | |
| 2011/0265524 | A1* | 11/2011 | Kim | D06F 29/00 68/13 R |

FOREIGN PATENT DOCUMENTS

| | | | |
|---|---|---|---|
| CN | 101440562 | A | 5/2009 |
| CN | 102844486 | A | 12/2012 |
| EP | 2 065 505 | A1 | 6/2009 |
| JP | 2001-017790 | A | 1/2001 |
| KR | 10-2003-0082634 | A | 10/2003 |
| WO | WO 2009/134018 | A2 | 11/2009 |
| WO | WO 2012/150539 | A2 | 11/2012 |

OTHER PUBLICATIONS

European Search Report issued in Application No. 14182474.8 dated Mar. 10, 2015.

* cited by examiner

【Figure 1】
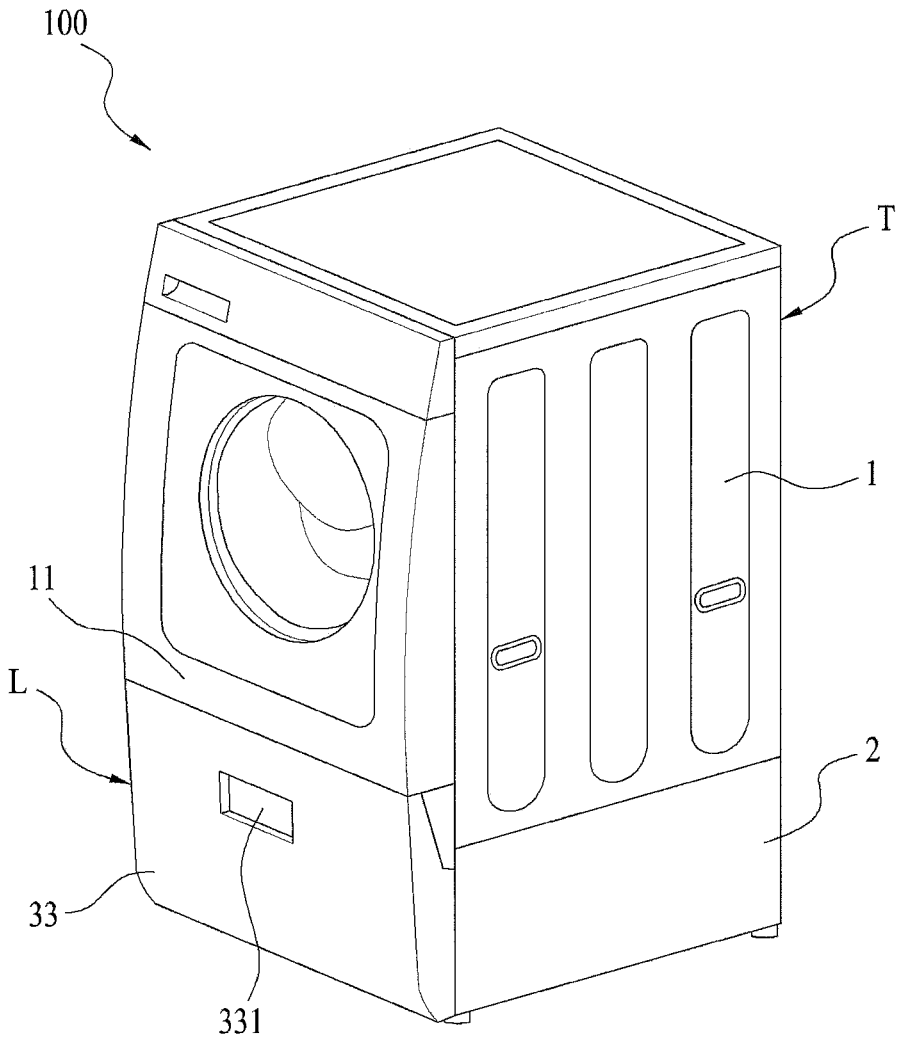

【Figure 2】
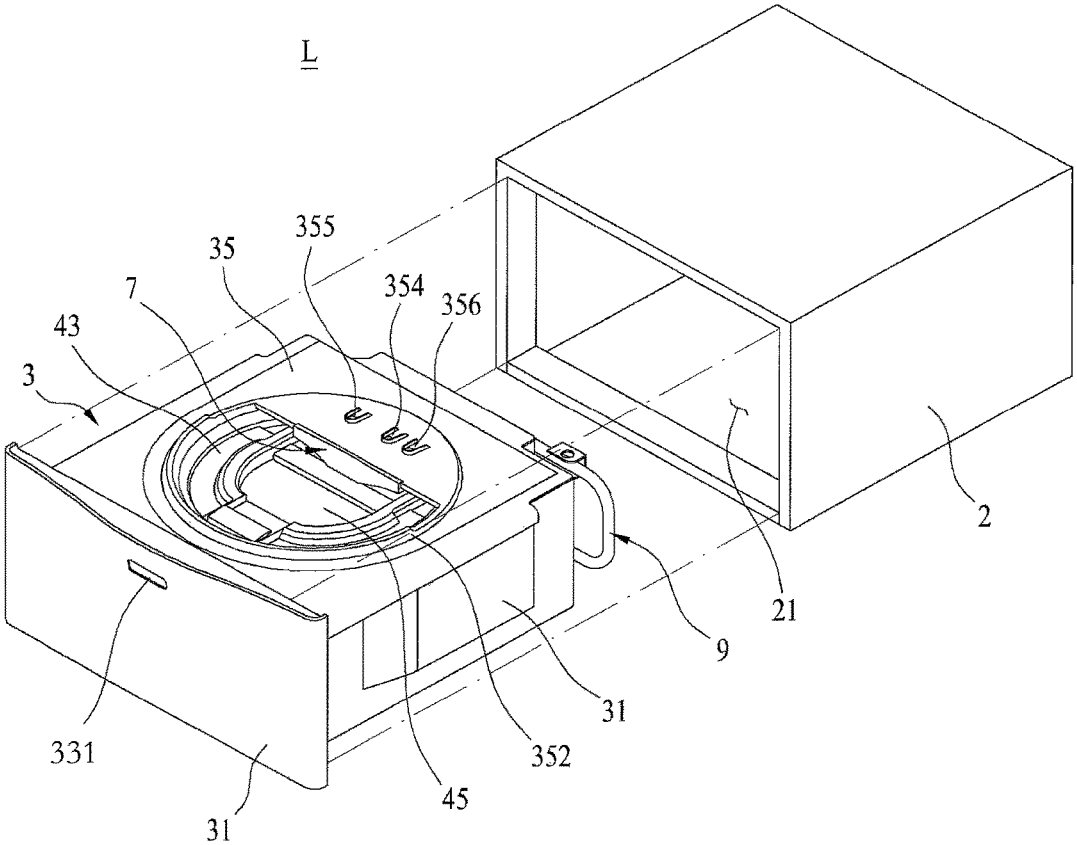

【Figure 3】
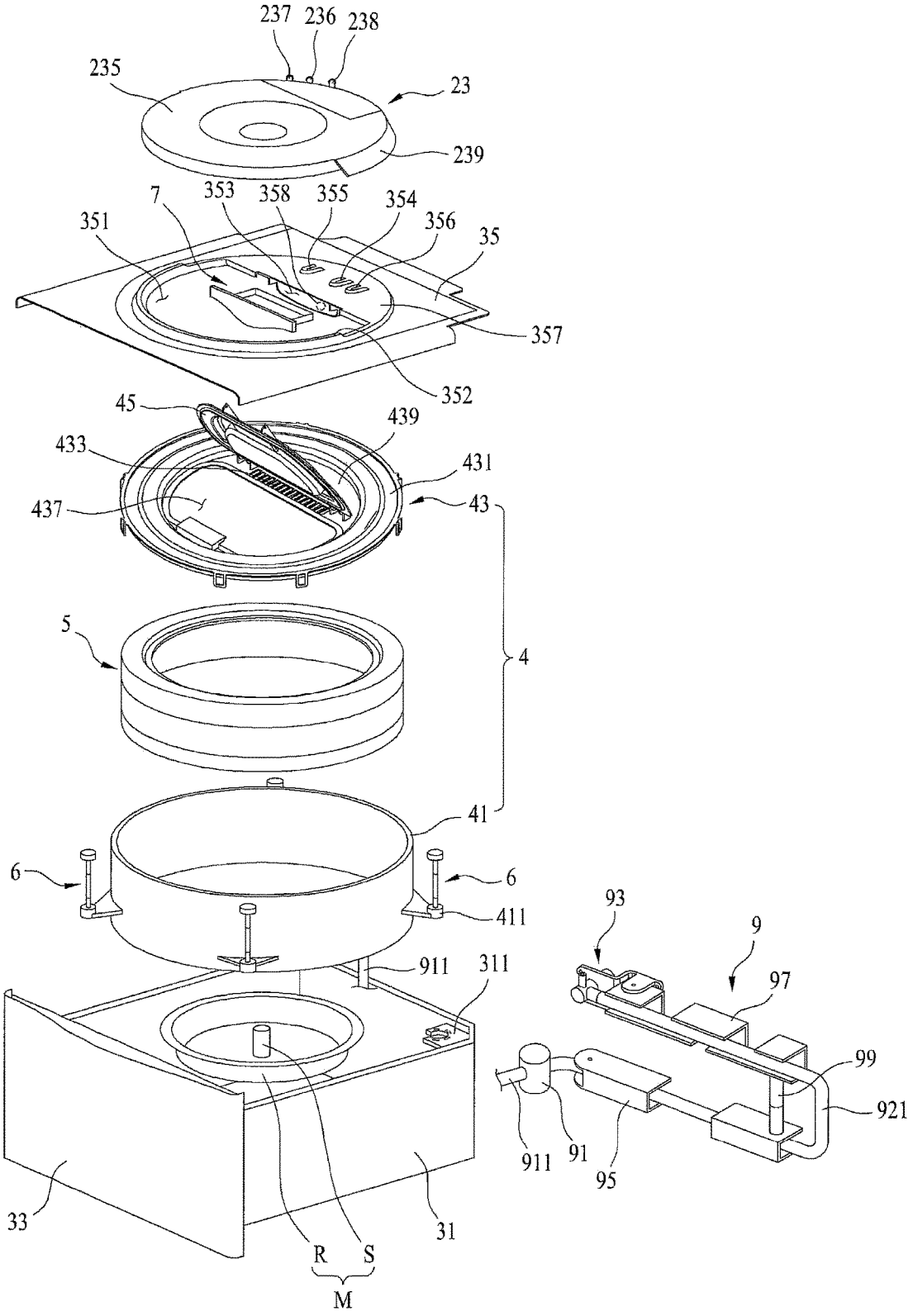

【Figure 4】
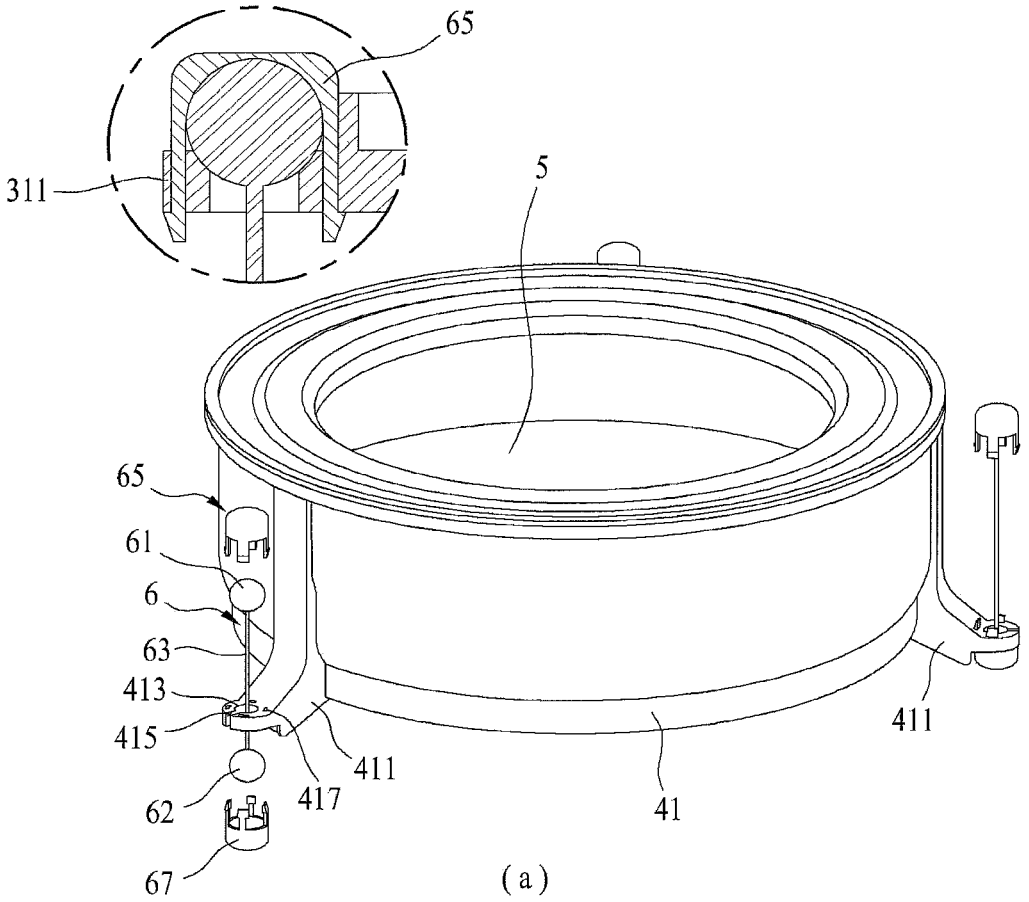
(a)
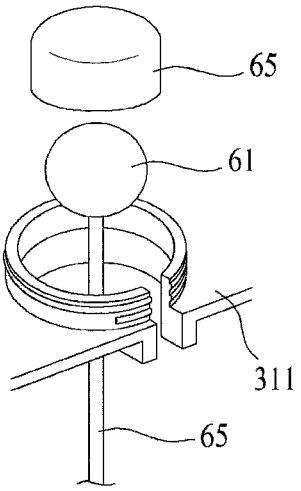
(b)

【Figure 5】
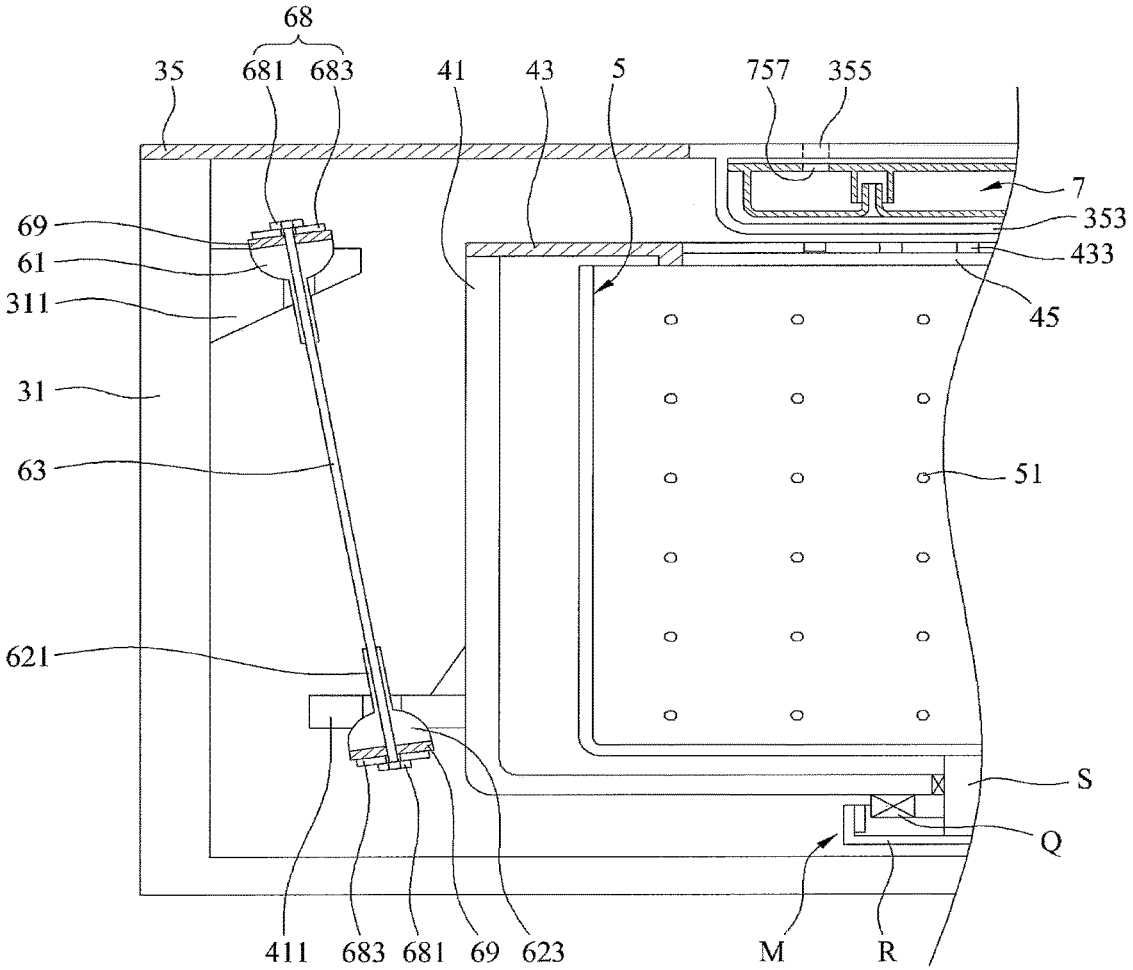

FIG. 6
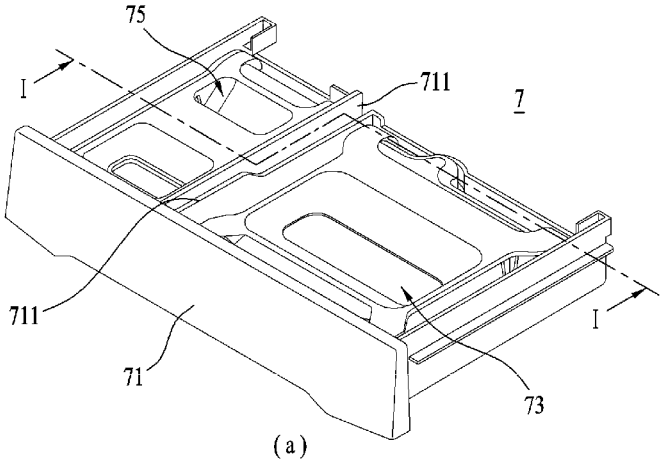
(a)
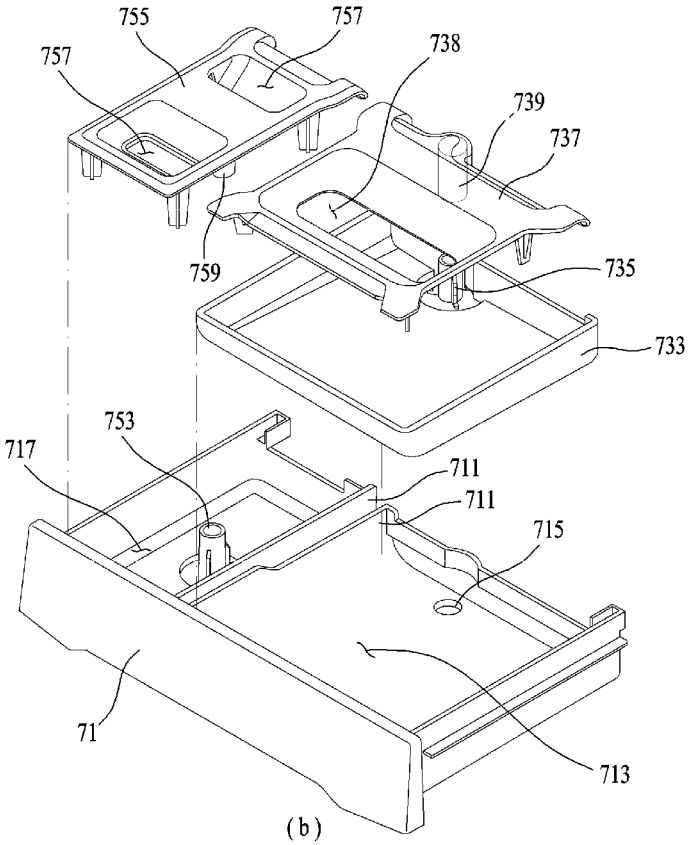
(b)

【Figure 7】

【Figure 9】
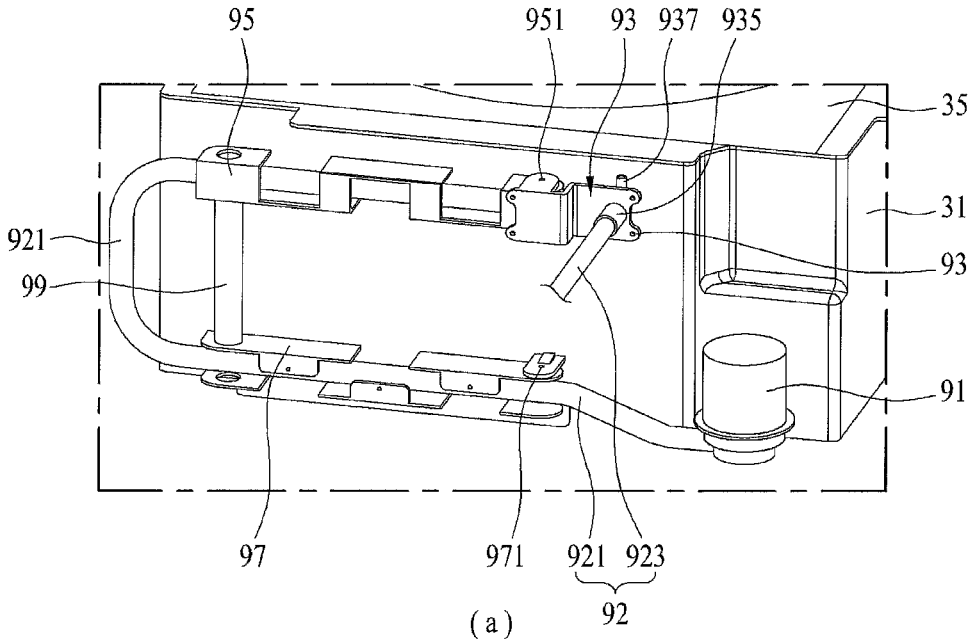
(a)
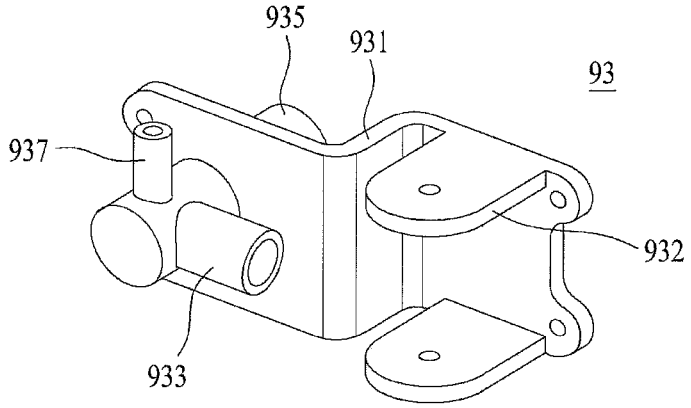
(b)

【Figure 10】
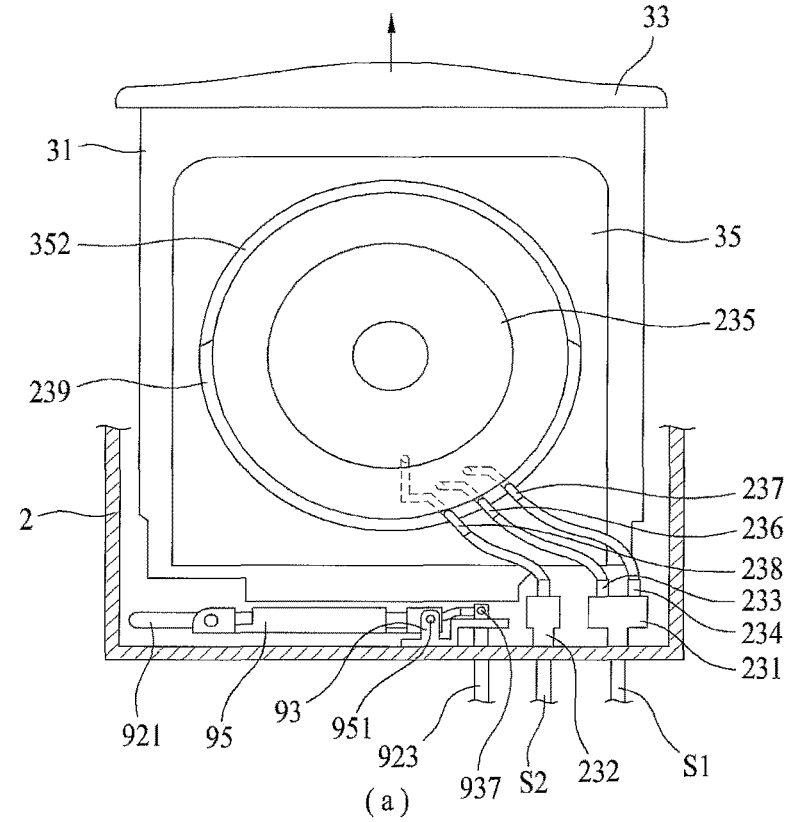
(a)
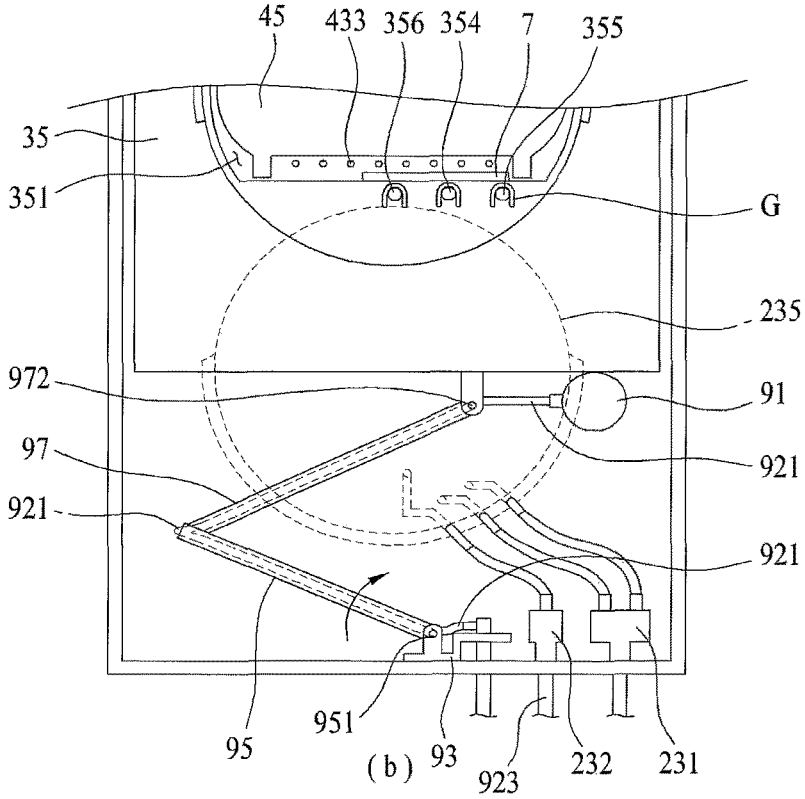
(b)

LAUNDRY TREATING APPARATUS

CROSS-REFERENCE TO RELATED APPLICATION

This application claims priority under 35 U.S.C. §119 to Korean Application No. 10-2013-0102241, filed Aug. 28, 2013, the subject matter of which is incorporated herein by reference.

BACKGROUND

1. Field

Embodiments may relate to a laundry treating apparatus.

2. Background

A laundry treating apparatus is an apparatus for performing washing or rinsing of laundry or an apparatus for performing both washing and rinsing of laundry.

A laundry treating apparatus may be installed indoors on a floor surface. In case of a front loading type laundry treating apparatus (known as a drum washing machine) into which laundry is introduced from a front, an inlet through which the laundry is introduced into the laundry treating apparatus is located at a comparatively low position. Therefore, a user may need to bend over to introduce and withdraw laundry into and from the laundry treating apparatus.

In order to remove such inconvenience, among laundry treating apparatuses, there is a front loading type laundry treating apparatus having a support installed under a main body to raise a height of an input hole.

However, support provided on the laundry treating apparatus may be used as only a unit to raise the height of the input hole or a unit to store accessories required for washing, but may not exhibit a laundry treating function, such as washing and/or drying.

SUMMARY OF THE INVENTION

Embodiments may relate to a laundry treating apparatus that substantially obviates one or more problems due to limitations and disadvantages of related art.

Embodiments may provide a laundry treating apparatus in which two apparatuses exhibiting a laundry treating function are combined with each other.

Embodiments may provide a laundry treating apparatus that is detachably attached to another apparatus exhibiting a laundry treating function and may perform a washing function.

A laundry treating apparatus may include a first treating apparatus having a space to wash or dry laundry and a second treating apparatus detachably provided on the first treating apparatus. The second treating apparatus may include a cabinet detachably provided on the first treating apparatus and forming an external appearance of the second treating apparatus, a drawer including a drawer body provided so as to be withdrawn from the cabinet and an input hole formed through an upper surface of the drawer body, a tub including a tub body provided within the drawer body and storing wash water and a tub input hole provided on the upper surface of the tub body so as to communicate with the input hole, a detergent supply unit provided so as to be withdrawn from the drawer body toward a center of the input hole and providing a space for storing a detergent, and a water supply unit supplying wash water to the detergent supply unit to supply the detergent stored in the detergent supply unit to the tub body.

The drawer may further include channel communication parts formed through the upper surface of the drawer body and communicating with the detergent supply unit, and the water supply unit may include an input hole cover fixed to the cabinet so as to close the input hole when the drawer is located within the cabinet and channels provided on the input hole cover so that water is supplied to the channels and detachably combined with the channel communication parts.

The drawer may further include a support part provided so as to close a portion of the input hole and having the channel communication parts provided thereon and a reception part provided on the support part, located under the channel communication parts, receiving the detergent supply unit so as to be withdrawn from the reception part, and guiding the detergent and wash water discharged from the detergent supply unit to the tub body.

The detergent supply unit may include a supply unit body provided so as to be withdrawn from the reception part and storage units provided within the supply unit body, receiving wash water from the channel communication parts, and discharging the wash water to the reception part.

The tub may further include a door support part provided so as to close a portion of the tub input hole, a door provided on the door support part to open and close the tub input hole, and an influx part provided on the door support part and allowing the wash water and detergent discharged from the reception part to be introduced into the tub body.

The storage units may include a first storage unit and a second storage unit provided on the supply unit body. The channel communication parts may include a first channel communication part communicating with the first storage unit and a second channel communication part communicating with the second storage unit. The channels may include a first channel detachably combined with the first channel communication part and a second channel detachably combined with the second channel communication part.

The water supply unit may further include a first water supply valve selectively or simultaneously supplying wash water to the first channel and the second channel.

The channel communication parts may further include a third channel communication part communicating with the first storage unit. The channels may further include a third channel detachably combined with the third channel communication part and supplying heated wash water to the third channel communication part.

The detergent supply unit may include reception spaces provided on the supply unit body and storing detergents, covers provided above the reception spaces, holes provided on the covers and introducing wash water supplied through the channel communication parts to the reception spaces, discharge pipes extending from the bottoms of the reception spaces toward the covers and discharging the detergents in the reception spaces to outside of the reception spaces, and reception pipes extending from the covers toward bottoms of the reception spaces so that the discharge pipes may be inserted into the reception pipes and guiding wash water, introduced into the reception spaces through the holes, to the discharge pipes.

Each of the storage units may include a detachable body detachably provided on the supply unit body and providing a space for storing a detergent, a cover provided above the detachable body, a hole provided on the cover and introducing wash water supplied through one of the channel communication parts into the detachable body, a discharge pipe extending from the bottom of the detachable body toward the cover and discharging the wash water in the detachable body to the supply unit body, and a reception pipe extending from the cover toward the bottom of the detachable body so that the discharge pipe may be inserted into the reception pipe and guiding wash water, introduced into the detachable body through the hole, to the discharge pipe, and the supply unit body may further include a discharge holes communicating the reception part supporting the support unit body and the discharge pipe with each other.

The laundry treating apparatus may further include a first sealing part protruding from an outer circumferential surface of the input hole toward the input hole cover and a second sealing part protruding from the outer circumferential surface of the input hole cover toward the input hole, and the first sealing part and the second sealing part may be combined with each other and thus form a cylinder surrounding the outer circumferential surface of the input hole.

The first sealing part may be provided at a portion of the outer circumferential surface of the input hole located in the withdrawal direction of the drawer, and the second sealing part may be provided at a portion of the outer circumferential surface of the input hole cover located in the opposite direction to the withdrawal direction of the drawer.

The laundry treating apparatus may further include a pump fixed to the outer surface of the drawer body, a tub connection pipe guiding wash water stored in the tub body to the pump, a drain pipe unit guiding wash water discharged from the pump to the outside of the cabinet, and a communication unit selectively communicating the drain pipe unit with external air.

The laundry treating apparatus may further include a first frame rotatably fixed to the cabinet and guiding the drain pipe unit to the communication unit, a second frame rotatably fixed to the drawer body, located below the first frame, and guiding the drain pipe unit to the pump, and a frame rotary shaft rotatably connecting the first frame and the second frame and separating the first frame and the second frame by a designated distance.

The laundry treating apparatus may further include a cabinet connection shaft rotatably fixing the first frame to the communication unit fixed to the cabinet and a drawer rotary shaft rotatably fixing the second frame to the drawer body.

BRIEF DESCRIPTION OF THE DRAWINGS

Arrangements and embodiments may be described in detail with reference to the following drawings in which like reference numerals refer to like elements and wherein:

FIG. 1 is a perspective view of a laundry treating apparatus in accordance with an example embodiment;

FIG. 2 is a view of a second treating apparatus in accordance with an example embodiment;

FIG. 3 is an exploded view of the second treating apparatus;

FIGS. 4(*a*) and 4(*b*) and FIG. 5 are views of tub supports provided in the second treating apparatus;

FIGS. 6(*a*) and 6(*b*) and FIG. 7 are views of a detergent supply unit provided in the second treating apparatus;

FIGS. 9(*a*) and 9(*b*) and FIGS. 10(*a*) and 10(*b*) are views illustrating a drainage unit provided in the second treating apparatus.

DETAILED DESCRIPTION

Figure 7:
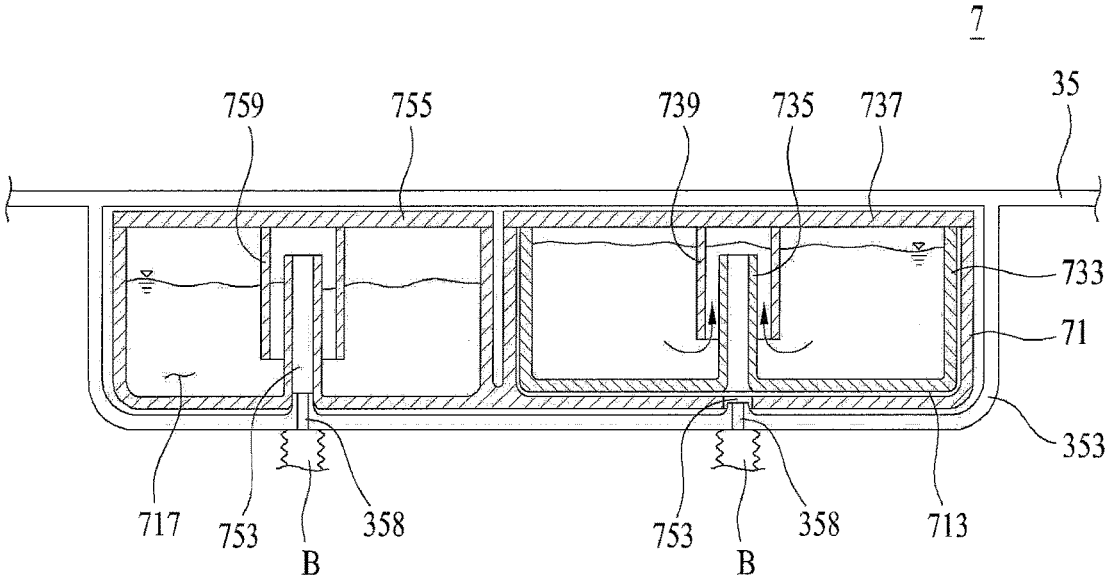

Reference may now be made in detail to embodiments, examples of which are illustrated in the accompanying drawings. The configuration or control method of an apparatus that will be described below has been made only for a better understanding but does not limit the scope and spirit. Further, same or similar elements are denoted by the same reference numerals even though they are depicted in different drawings and a detailed description thereof may thus be omitted because it is considered to be unnecessary.

A laundry treating apparatus 100 may include a first treating apparatus T exhibiting a laundry treating function (such as washing or drying of laundry) and a second treating apparatus L detachably provided on the first treating apparatus T and exhibiting the laundry treating function (such as washing or drying of laundry). However, the laundry treating apparatus 100 may include the second treating apparatus L alone.

The laundry treating apparatus 100 having both the first treating apparatus T and the second treating apparatus L may be described below for ease of description.

The first treating apparatus T may include a first cabinet 1 forming an external appearance of the first treating apparatus T, a first tub provided within the first cabinet 1 and storing wash water, a first drum provided within the first tub so as to be rotatable and storing laundry, a first water supply unit supplying wash water to the first tub, and a first drainage unit discharging the wash water stored in the first tub to the outside of the first cabinet 1.

A first input hole through which laundry is put into and withdrawn from the first treating apparatus T may be provided on (or at) the first cabinet 1. The first input hole is opened and closed by a first door 11 rotatably combined with the first cabinet 1.

A first tub input hole communicating with the first input hole may be provided on the first tub, and thus a user may put laundry into the first drum when the first door 11 is opened.

If the first treating apparatus T performs a laundry drying function also, a hot air supply device for supplying heated air to the first tub may be further provided within the cabinet 1.

The hot air supply device may include a circulation channel to circulate air within the first tub and a heat exchange unit provided within the circulation channel and dehumidifying and heating air discharged from the first tub.

The hot air supply device may include a discharge channel discharging air within the first tub to outside of the first cabinet 1, a supply channel supplying air at outside of the first cabinet 1 to the first tub, and a heat exchange unit provided within the supply channel.

Differently from the above description, if the first treating apparatus T is provided so as to perform only drying of laundry, the first treating apparatus T does not require the first tub and the hot air supply device is provided to supply hot air to the first drum provided within the first cabinet 1.

As shown in FIG. 2, the second treating apparatus L may include a cabinet 2 detachably provided on the first cabinet 1 and a drawer 3 to be withdrawn from the cabinet 2.

The cabinet 2 may form an external appearance of the second treating apparatus L and support the first cabinet 1 of the first treating apparatus T. That is, the cabinet 2 may raise the height of the first door 11 provided on the first cabinet 1 and thus increase a user's convenience when the user puts or withdraws laundry into and from the first treating apparatus T. However, differently from FIG. 2, the second cabinet 2 may be provided on an upper surface or a side surface of the first cabinet 1.

An opening 21 may be provided on the cabinet 2 and the drawer 3 may be withdrawn from the cabinet 2 or inserted into the cabinet 2 through the opening 21. If the second treating apparatus L is provided on a lower surface of the first treating apparatus T, the opening 21 may be provided in a direction in which the first door 11 is located.

As shown in FIG. 3, the drawer 3 may include a drawer body 31, an upper surface of which is opened, and a drawer cover 35 provided on the opened upper surface of the drawer body 31.

That is, the drawer body 31 may have a hexahedral shape forming a vacant inner space and the drawer cover 35 may be fixed to the drawer body 31 to form the upper surface of the drawer body 31.

A drawer panel 33 may be provided on the front surface of the drawer body 31. A handle 331 may be provided on the drawer panel 33, and thus a user may withdraw the drawer body 31, inserted into the cabinet 2, from the cabinet 2 to the outside of the cabinet 2 by using the handle 331.

The drawer cover 35 may include an input hole 351 for communicating an inside of the drawer body 31 with outside of the drawer body 31 and a reception part 353 for supporting a detergent supply unit 7 so that the detergent supply unit 7 storing a detergent may be withdrawn toward a center of the input hole 351.

The input hole 351 may be a circular hole formed at the drawer cover 35. The reception part 353 may be provided on a support part 357 provided on the drawer cover 35 to close a portion of the input hole 351.

The support part 357 may be provided in a plate shape, and the reception part 353 may protrude from the lower surface of the support part 357 to support the detergent supply unit 7.

A plurality of channel communication parts 354, 355 and 356 for guiding wash water to the detergent supply unit 7 located within the reception part 353 may be provided on the support part 357. The channel communication parts 354, 355 and 356 may be formed through the support part 357.

The reception part 353 may discharge detergent and wash water from the detergent supply unit 7 to the tub 4.

The reception part 353 may have a larger sectional area than the sectional area of the detergent supply unit 7, and thus detergent and wash water discharged from the detergent supply unit 7 may be discharged to the tub 4 through a space between a bottom of the detergent supply unit 7 and a bottom of the reception part 353.

The reception part 353 may discharge the detergent and wash water from the detergent supply unit 7 to the tub 4 through a reception part discharge pipe 358 formed through a bottom of the reception part 353.

The tub 4 storing wash water and a drum 5 provided in the tub 4 so as to be rotatable and storing laundry may be further provided within the drawer body 31.

The tub 4 may include a tub body 41 provided within the drawer body 31 to store wash water and having an opened upper surface, and a tub cover 43 provided on the opened upper surface of the tub body 41.

The tub cover 43 may include a cover body 431 located under the drawer cover 35 and fixed (or attached) to the opened upper surface of the tub body 41, and a tub input hole 437 formed through the cover body 431 and provided at a position corresponding to the input hole 351.

The tub input hole 437 may be opened and closed by a door 45 rotatably combined with the tub cover 43. The tub cover 43 may further include a door support part 439 provided so as to close a portion of the tub input hole 437.

The door support part 439 may include an influx part 433 through which wash water and detergent discharged from the reception part 353 may be introduced into the tub body 41.

The influx part 433 may include a plurality of through holes formed through the door support part 439 and causing wash water discharged from the reception part 353 to be introduced into the tub body 41, or include hoses B (FIG. 7) communicating an inside of the reception part 353 with an inside of the tub body 41.

The tub 4 may be fixed (or attached) to an inside of the drawer body 31 by tub supports 6 connecting the tub body 41 and the drawer body 31.

As shown in FIGS. 4(*a*) and 4(*b*), the tub support 6 may include a spherical drawer pivot 61 combined with the drawer body 31, a spherical tub pivot 62 combined with the tub body 41, a rod 63 connecting the drawer pivot 61 and the tub pivot 62, a drawer coupling part 65 fixing (or attaching) the drawer pivot 61 to the drawer body 31, and a tub coupling part 67 fixing (or attaching) the tub pivot 62 to the tub body 41.

The drawer pivot 61 may be supported by a drawer bracket 311 provided on the drawer body 31, and the tub pivot 62 may be supported by a tub bracket 411 provided on the tub body 41. The drawer coupling part 65 may be combined with the drawer bracket 311 and the tub coupling part 67 may be combined with the tub bracket 411.

The drawer bracket 311 and the tub bracket 411 may have the same structure. The tub bracket 411 may include a loading surface 413 on which the spherical tub pivot 62 is loaded, a cut surface 415 connecting the outer circumferential surface of the bracket 411 and the loading surface 413 so that the rod 63 is inserted into the cut surface 415, and a hook hole 417 into which a hook provided on the tub coupling part 67 is inserted.

The tub support 6 may stably support the tub 4, although the tub 4 may move within the drawer body 31 due to vibration.

The tub supports 6 may be provided on the tub body 41 so as to be separated from each other by an angle of 90 degrees (four tub supports) or to be separated from each other by an angle of 120 degrees (three tub supports).

The drawer coupling part 65 and the tub coupling part 67 may be formed using a thread and a thread groove (FIG. 4(*b*)), rather than using a hook and a hook hole.

FIG. 5 illustrates a tub support 6 in accordance with an example embodiment. The tub support 6 may include a drawer pivot 61 combined with the drawer bracket 311, a tub pivot 62 combined with the tub bracket 411, a rod 63 connecting the drawer pivot 61 and the tub pivot 62, and rod fixing units 68 combining the rod 63 to the respective pivots 61 and 62.

The drawer pivot 61 and the tub pivot 62 may have the same structure. The tub pivot 62 may include a rod coupling part 621 for receiving the rod 63 and a bracket coupling part 623 extending from the rod coupling part 621 and connected to the tub bracket 411.

The bracket coupling part 623 may be formed in a spherical or semi-spherical shape and the tub bracket part 411 may include a loading surface on which the outer circumferential surface of the bracket coupling part 623 may be loaded.

The rod fixer 68 may include a nut 681 and a washer 683, and an elastic support body 69 may be provided between the washer 683 and the pivot 61 or 62. The elastic support body 69 may be formed of rubber, for example.

The tub support 6 may effectively control vibration in a direction parallel with the bottom of the tub body 41 and vibration in a height direction of the tub body 41.

The drum 5 provided within the tub body 41 may be rotated within the tub body 41 by a driving unit M. The driving unit M may include a stator Q fixed to the outer surface of the tub body 41, a rotor R rotated by electromagnetic interaction with the stator Q, and a rotary shaft S formed through the bottom of the tub body 41 and connecting the drum 5 and the rotor R.

The detergent supply unit 7 provided on a detergent channel supplied to the tub 4 and storing a detergent may be provided within the reception part 353 provided on the drawer cover 35, as described above.

The detergent supply unit 7 may be characterized in that it may be withdrawn from the reception part 353 toward the center of the input hole 351, and may include a supply unit body 71 to be withdrawn from the reception part 353 and storage units provided within the supply unit body 71 for storing detergent, as shown in FIGS. 6(*a*) and 6(*b*).

The storage units may include a first storage unit 73 and a second storage unit 75 within the supply unit body 71 to store different kinds of detergents.

The supply unit body 71 may include a first reception space 713 and a second reception space 717 that are separated from each other by diaphragms 711 (or a diaphragm).

The first reception space 713 and the second reception space 717 may be detergent storage spaces and/or provide spaces in which detergent storage units are detachably received.

If the first reception space 713 and the second reception space 717 provide spaces in which detergent storage units are detachably received, the detergent storage units may be conveniently cleaned.

An example may be described in which the second reception space 717 provides a space for storing a detergent and the first reception space 713 provides a space with which a detachable body 733 storing a detergent is detachably combined.

If the second reception space 717 provides a space for storing a detergent, the second storage unit 75 may include a second cover 755 provided above (or on) the second reception space 717, a second hole 757 provided on the second cover 755 and introducing wash water supplied through one of the channel communication parts 354, 355, and 356 to the second reception space 717, and a second discharge pipe 753 provided on the bottom of the second reception space 717 and discharging the detergent in the second reception space 717 to the outside.

The second storage unit 75 may supply all the amount of the detergent, stored in the second reception space 717, together with wash water to the tub 4 by using siphonage.

The second discharge pipe 753 may extend from the bottom of the second reception space 717 toward the second cover 755, and a second reception pipe 759 may be further provided on the second cover 755. The second reception pipe 759 may extend from the second cover 755 toward the bottom of the second reception space 717 so that the second discharge pipe 753 may be inserted into the second reception pipe 759.

The second reception pipe 759 may have a length so as not to contact the bottom of the second reception space 717 such that wash water introduced into the second reception space 717 may move to the second discharge pipe 753.

The first storage unit 73 may include a detachable body 733 detachably provided in the first reception space 713 and providing a space for storing a detergent, a first cover 737 provided above (or on) the detachable body 733, a first hole 738 provided on the first cover 737 and introducing wash water supplied through one of the channel communication parts 354, 355, and 356 into the detachable body 733, and a first discharge pipe 735 discharging the wash water supplied to the detachable body 733 to a first discharge hole 715 provided in the first reception space 713.

The first storage unit 73 may also supply the detergent, stored in the detachable body 733, to the tub 4 by using siphonage.

The first discharge pipe 735 may extend from the bottom of the detachable body 733 toward the first cover 737, and a first reception pipe 739 may be further provided on the first cover 732. The first reception pipe 739 may extend from the first cover 737 toward the bottom of the detachable body 733 so that the first discharge pipe 735 may be inserted into the first reception pipe 739.

As shown in FIG. 7, the first reception pipe 739 may be formed to have a length so as not to contact the bottom of the detachable body 733 such that wash water introduced into the detachable body 733 may move to the first discharge pipe 735. FIG. 7 is a sectional view of FIG. 6(*a*) when sectioned by dash line I-I (shown in FIG. 6(*a*)).

The second treating apparatus L having the above-described structure may supply wash water to the detergent storage unit 7 through a water supply unit 23 provided in the cabinet 2, and the wash water supplied to the detergent storage unit 7 together with detergent may be supplied to the tub 4.

As shown in FIG. 3, the water supply unit 23 may include an input hole cover 235 having channels 236, 237, and 238 detachably attached to the channel communication parts 354, 355, and 356 provided on the drawer cover 35, and water supply valves 231 and 232 (FIGS. 10(*a*) and 10(*b*)) for supplying wash water supplied from a water source to the channels 236, 237, and 238.

If the second treating apparatus L washes laundry using non-heated wash water (cold water) alone, the channel communication parts may include a first channel communication part 354 for supplying wash water to the first storage unit 73 and a second channel communication part 355 for supplying wash water to the second storage unit 75 and the channels may include a first channel 236 connected to the first channel communication part 354 and a second channel 237 connected to the second channel communication part 355.

However, if the second treating apparatus L also uses heated wash water (warm water) to wash laundry, then the channel communication parts may further include a third channel communication part 356 supplying warm water to the first storage unit 73 or the second storage unit 75 and the channels may further include a third channel 238 connected to the third channel communication part 356.

The water supply valves may include a first water supply valve 231 (FIGS. 10(*a*) and 10(*b*)) for supplying cold water supplied from a first water supply pipe S1 (FIGS. 10(*a*) and 10(*b*)) to the first channel 236 and the second channel 237 and a second water supply valve 232 (FIGS. 10(*a*) and 10(*b*)) for supplying warm water supplied from a second water supply pipe S2 (FIGS. 10(*a*) and 10(*b*)) to the third channel 238.

The first water supply valve 231 may include a first pipe 233 connected to the first channel 236 and a second pipe 234 connected to the second channel 237 and may have a two-way valve structure that may simultaneously open both the first pipe 233 and the second pipe 234 or open only one of the first pipe 233 and the second pipe 234.

An elastic pipe C may be provided in each of the respective channels 236, 237 and 238 detachably combined with the respective channel communication parts 354, 355 and 356. The elastic pipes C may facilitate combination between the channel communication parts 354, 355 and 356 and the channels 236, 237 and 238 when the drawer 3 is withdrawn from the cabinet 2 or is inserted into the cabinet 2.

Figure 8:
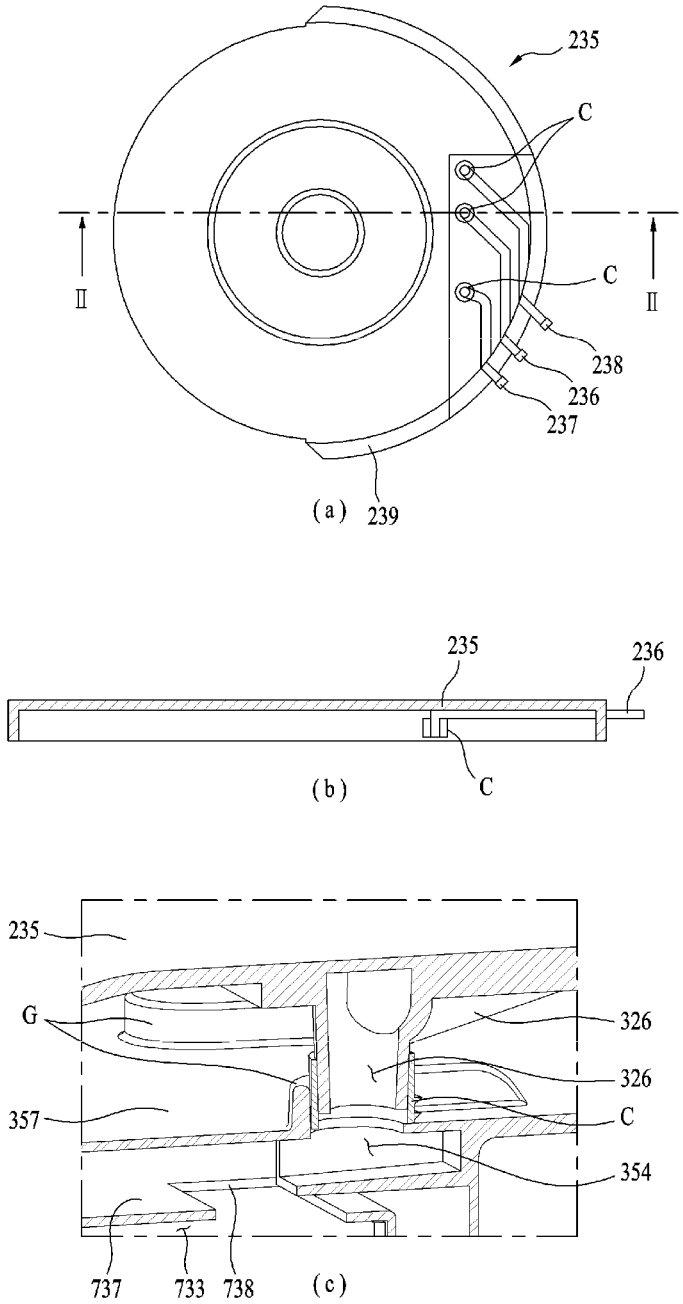
FIGS. 8(*a*) to 8(*c*) are views of an input hole cover provided in the second treating apparatus.

As shown in FIGS. 8(*a*) to 8(*c*), the elastic pipes C may be provided as separate hoses combined with the ends of the respective channels 236, 237 and 238 or be provided by forming the respective channels 236, 237 and 238 of an elastic material. FIG. 8(b) is a sectional view of FIG. 8(*a*) when sectioned by dash line II-II (as shown in FIG. 8(*a*)).

The input hole cover 235 (on which the first channel 236, the second channel 237, and the third channel 238 are provided) may be provided so as to open the input hole 351 when the drawer 3 is withdrawn from the cabinet 2 and to close the input hole 351 when the drawer 3 is inserted into the cabinet 2.

Although the second treating apparatus L includes the door 45 for opening and closing the tub input hole 437, the input hole cover 235 may prevent wash water from leaking through the input hole 351 provided on the drawer cover 35 during a washing process.

For this purpose, a first sealing part 352 protruding toward the input hole cover 235 may be provided on an outer circumferential surface of the input hole 351 and a second sealing part 239 protruding toward the input hole 351 may be provided on the outer circumferential surface of the input hole cover 235.

Based on an insertion direction and a withdrawal direction of the drawer 3, the first sealing part 352 may be provided only at a portion of the outer circumferential surface of the input hole 351 located in the withdrawal direction of the drawer 3 (in a direction in which the drawer panel 33 is provided) and the second sealing part 239 may be provided only at a portion of the outer circumferential surface of the input hole cover 235 located in the opposite direction to the withdrawal direction of the drawer 3.

The first sealing part 352 and the second sealing part 239 may be combined with each other and may thus form a cylinder surrounding the outer circumferential surface of the input hole 351, when the drawer 3 is inserted into the cabinet 2.

Wash water stored in the tub 4 may be discharged to outside of the cabinet 2 through a drainage unit 9. The structure of the drainage unit 9 may be described with reference to FIGS. 9(*a*) and 9(*b*).

The drainage unit 9 may include a pump 91 fixed (or attached) to the outer surface of the drawer body 31, a tub connection pipe 911 (FIG. 3) for guiding wash water stored in the tub body 41 to the pump 91, a drain pipe unit 92 for guiding wash water discharged from the pump 91 to outside of the cabinet 2, and a communication unit 93 for selectively communicating the drain pipe unit 92 with external air.

The tub connection pipe 911 may connect the bottom of the tub body 41 and the pump 91, the pump 91 may be fixed (or attached) to the lower portion of the rear surface of the drawer body 31, and the communication unit 93 may be located at the upper portion of the rear surface of the drawer body 31.

The drain pipe unit 92 may include a first drain pipe 921 for connecting the pump 91 and the communication unit 93, and a second drain pipe 923 for guiding wash water supplied to the communication unit 93 to outside of the cabinet 2.

The first drain pipe 921 may be formed in a shape in which a part extending along the lower portion of the rear surface of the drawer body 31 and a part extending along the upper portion of the rear surface of the drawer body 31 are connected, and the communication unit 93 may be connected to the part of the first drain pipe 921 extending along the upper portion of the rear surface of the drawer body 31.

When the drawer 3 is withdrawn from the cabinet 2 or is inserted into the cabinet 2, the position of the first drain pipe 921 may be controlled by a frame assembly provided between the rear surface of the drawer body 31 and the cabinet 2 to be retractable.

The frame assembly may include a second frame 97 rotatably fixed (or attached) to the drawer body 31 and receiving the first drain pipe 921 extending from the pump 91 along the lower portion of the rear surface of the drawer body 31, a first frame 95 rotatably fixed (or attached) to the cabinet 2 and guiding the first drain pipe 921 extending along the upper portion of the rear surface of the drawer body 31 to the communication unit 93, and a frame rotary shaft 99 rotatably connecting the first frame 95 and the second frame 97 and separating the first frame 95 and the second frame 97 by a designated distance.

The first frame 95 and the second frame 97 may be provided in a bar shape including a space in which the first drain pipe 921 may be received.

The second frame 97 may be rotatably combined with the rear surface of the drawer body 31 through a drawer rotary shaft 971, and the first frame 95 may be rotatably combined with the communication unit 93 (fixed or attached to the cabinet 2) through a cabinet connection shaft 951.

The communication unit 93, as shown in FIG. 9(*b*), may include a communication unit body 931 fixed (or attached) to the cabinet 2, brackets 932 connecting the communication unit body 931 and the first frame 95 through the cabinet connection shaft 951, a first connection pipe 933 fixed to the communication unit body 931 and connected to the first drain pipe 921, a second connection pipe 937 fixed to the communication unit body 931 and connecting the first connection pipe 933 and the second drain pipe 923, and a communication pipe 937 provided on at least one of the first connection pipe 933 and the second connection pipe 935 and selectively supplying external air to insides of the first connection pipe 933 and the second connection pipe 935.

The communication pipe 937 may selectively supply external air to the first connection pipe 933 and the second connection pipe 935 through various methods. For example, a check valve may be used for closing the communication pipe 937 when a water pressure in the connection pipes 933 and 935 is high and opening the connection pipe 937 when the water pressure in the connection pipes 933 and 935 is low.

The operating process of the second treating apparatus L may be described with reference to FIGS. 10(*a*) and 10(*b*).

A user may withdraw the drawer body 31 from the cabinet 2 by using the handle 331 provided on the drawer panel 33.

As shown in FIG. 10(*b*), when the drawer body 31 is withdrawn from the cabinet 2, the input hole 351 provided on the drawer 3 may be exposed to outside of the cabinet 2 but the input hole cover 235 fixed (or attached) to the inside of the cabinet 2 may not be withdrawn to the outside of the cabinet 2.

The first frame 95 may be rotated about the cabinet connection shaft 951 in the clockwise direction and the second frame 97 may be rotated about the frame rotary shaft 971 in the counterclockwise direction.

The first drain pipe 921 may be supported by the first frame 95 and the second frame 97, and may thus maintain connection to the pump 91 and the communication unit 93 even if the drawer body 31 is withdrawn from the cabinet 2.

The door 45 provided on the tub 4 may be located under the input hole 351 provided on the drawer cover 35 and the drum 5 may be provided under the door 45. Therefore, the user may open the door 45 in a direction toward the input hole 351 and provide laundry into the drum 5 provided within the tub body 41.

When the laundry is supplied to the drum 5, the user may withdraw the detergent supply unit 7 provided on the drawer cover 35 toward a center of the input hole 351 and then put detergent into the detergent supply unit 7.

A detergent for a washing operation may be stored in the first storage unit 73, and a fabric rinse required for a rinsing operation may be supplied to the second storage unit 75.

When detergent supply to the detergent supply unit 7 has been completed, the user may insert the drawer body 31 into the cabinet 2.

The second frame 97 may rotate about the frame rotary shaft 971 in the clockwise direction, and the first frame 95 may rotate about the cabinet connection shaft 951 in the counterclockwise direction.

The first drain pipe 921 supported by the first frame 95 and the second frame 97 may be located in a space formed between the rear surface of the drawer body 31 and the rear surface of the cabinet 2 without twist of the first drain pipe 921.

As shown in FIG. 10(*a*), when the drawer body 31 is inserted into the cabinet 2, the input hole 351 may be sealed by the first sealing part 352 and the second sealing part 239 as well as being closed by the input hole cover 235.

Further, when the drawer body 31 is inserted into the cabinet 2, the respective channels 236, 237 and 238 provided on the input hole cover 235 may be guided by guiders G provided on the outer circumferential surfaces of the respective channel communication parts 354, 355 and 356 and connected to the respective channel communication parts 354, 355 and 356.

If washing of laundry is carried out using warm water, the second treating apparatus L may supply the warm water to the first storage unit 73 of the detergent supply unit 7 through the second water supply valve 232, the third channel 238, and the third channel communication part 356.

However, if washing of laundry is carried out using cold water, the first water supply valve 231 may open the first pipe 233 alone and thus the cold water may be supplied to the first storage unit 73 alone through the first channel 236 and the first channel communication part 354.

As shown in FIG. 7, wash water supplied to the first storage unit 73 together with the detergent may be discharged to the tub cover 43 through the first discharge pipe 735 and the first discharge hole 715, and the wash water and detergent discharged to the tub cover 43 may be stored in the tub body 41 through the influx part 433.

Through holes 51 may be provided on the drum 5, and thus the wash water stored in the tub body 41 may be supplied to laundry via the through holes 51.

When wash water is supplied to the tub body 41, the second treating apparatus L may perform a washing operation in which the drum 5 is rotated through the driving unit M, and when the washing operation has been completed, a controller may drain the wash water in the tub body 41 through the pump 91.

When the pump 91 is operated, the wash water in the tub body 41 may be discharged to outside of the cabinet 2 through the first drain pipe 921, the communication unit 93, and the second drain pipe 923.

Since the pump 91 is fixed (or attached) to the lower portion of the rear surface of the drawer body 31 and the communication unit 93 is located at the upper portion of the rear surface of the drawer body 31, the wash water discharged from the tub body 41 may flow to the second rain pipe 923 via the lower portion and the upper portion of the rear surface of the drawer body 31.

If the communication unit 93 is not provided, wash water in the tub body 41 and wash water in the drain pipe 92 may be completely discharged to a sewer by siphonage during operation of the pump 91.

However, if the communication unit 93 is provided at the first drain pipe 921 when operation of the pump 91 is stopped, external air is introduced into the first drain pipe 921 and thus wash water in the first drain pipe 921 may flow in the direction toward the tub body 41 and thus remain in the tub connection pipe 911 (a pipe connecting the tub body 41 and the pump 91).

If a part of wash water remains in the tub connection pipe 911 (FIG. 3), flow of bad smells introduced from the sewer through the drain pipe 92 toward the tub body 41 may be prevented and rupture of the first drain pipe 21 due to freezing of wash water in the first drain pipe 921 may be prevented.

When the washing operation has been completed by the above-described operation, the second treating apparatus L may perform a rinsing operation to remove remaining contaminants and detergent from the laundry.

In the rinsing operation, the first water supply valve may supply cold water to the tub body 41 through the second storage unit 75 of the detergent supply unit 7, and during such a process, the fabric rinse stored in the second storage unit 75 may be supplied to the tub body 41.

When wash water is supplied to the tub body 41, the second treating apparatus L may rotate the drum 5, remove contaminants and detergent from the laundry, and then discharge the wash water to outside of the cabinet 2 through the drainage unit 9.

However, if the rinsing operation needs to be performed two or more times, the first water supply valve 231 may control the first pipe 233 and the second pipe 234 such that wash water is supplied to the tub body 41 through the first storage unit 73 and the first channel 236 in the first rinsing operation and wash water is supplied to the tub body 41 through the second storage unit 75 and the second channel 237 in the second rinsing operation.

When the rinsing operation has been completed, the second treating apparatus L may perform a spin-drying operation in which wash water is removed from the laundry by rotating the drum 5. Thereby, washing of the laundry may be completed.

Embodiments may provide a laundry treating apparatus in which two apparatuses performing a laundry treating function are combined with each other.

Embodiments may provide a laundry treating apparatus detachably provided on another apparatus performing a laundry treating function and exhibiting a washing function.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus comprising:

a first treating apparatus having a space to wash or dry laundry; and a second treating apparatus detachably provided on the first treating apparatus, wherein the second treating apparatus includes:

a cabinet detachably provided on the first treating apparatus, the cabinet to provide an external appearance of the second treating apparatus, a drawer having a drawer body and an input hole, the drawer body to be withdrawn from the cabinet, the input hole at an upper surface of the drawer body, an input hole cover fixed to the cabinet to close the input hole when the drawer is within the cabinet, a tub having a tub body and a tub input hole, the tub body provided within the drawer body to store wash water, and the tub input hole provided at an upper surface of the tub body to communicate with the input hole, a detergent supply unit to be withdrawn from the drawer body toward a center of the input hole, the detergent supply unit to provide a space for storing a detergent, channel communication parts formed through the upper surface of the drawer body and communicating with the detergent supply unit, channels provided on the input hole cover to supply water to the channel communication parts and detachably combined with the channel communication parts, and a water supply unit for supplying wash water to channels.

2. The laundry treating apparatus according to claim 1, wherein the drawer includes:

a support part to close a portion of the input hole and having the channel communication parts provided thereon; and a reception part on the support part and under the channel communication parts, the reception part to receive the detergent supply unit so as to be withdrawn from the reception part, and the reception part to guide the detergent and wash water from the detergent supply unit to the tub body.

3. The laundry treating apparatus according to claim 2, wherein the detergent supply unit includes:

a supply unit body to be withdrawn from the reception part; and storage units within the supply unit body, the storage units for receiving wash water from the channel communication parts, and for discharging the wash water to the reception part of the drawer.

4. The laundry treating apparatus according to claim 3, wherein the tub includes:

a door support part to close a portion of the tub input hole;

a door on the door support part to open and close the tub input hole; and an influx part on the door support part to allow the wash water and detergent from the reception part to be introduced into the tub body.

5. The laundry treating apparatus according to claim 3, wherein:

the storage units include a first storage unit and a second storage unit on the supply unit body;

the channel communication parts include a first channel communication part for communicating with the first storage unit and a second channel communication part for communicating with the second storage unit; and the channels include a first channel detachably combined with the first channel communication part and a second channel detachably combined with the second channel communication part.

6. The laundry treating apparatus according to claim 5, wherein the water supply unit includes a first water supply valve for selectively or simultaneously supplying wash water to the first channel and the second channel.

7. The laundry treating apparatus according to claim 6, wherein:

the channel communication parts include a third channel communication part for communicating with the first storage unit, and the channels include a third channel detachably combined with the third channel communication part for supplying heated wash water to the third channel communication part.

8. The laundry treating apparatus according to claim 3, wherein the detergent supply unit includes:

reception spaces provided on the supply unit body to store detergents;

covers provided on the reception spaces;

holes provided on the covers for introducing wash water supplied through the channel communication parts to the reception spaces;

discharge pipes extending from bottoms of the reception spaces toward the covers and discharging the detergents in the reception spaces to outside of the reception spaces; and reception pipes extending from the covers toward the bottoms of the reception spaces so that the discharge pipes may be inserted into the reception pipes and guiding wash water, introduced into the reception spaces through the holes, to the discharge pipes.

9. The laundry treating apparatus according to claim 3, wherein each of the storage units includes:

a detachable body detachably provided on the supply unit body for providing a space to store a detergent, a cover on the detachable body, a hole on the cover for introducing wash water supplied through one of the channel communication parts into the detachable body, a discharge pipe extending from the bottom of the detachable body toward the cover for discharging the wash water in the detachable body to the supply unit body, and a reception pipe extending from the cover toward the bottom of the detachable body so that the discharge pipe may be inserted into the reception pipe and guiding wash water, introduced into the detachable body through the hole, to the discharge pipe; and the supply unit body includes a plurality of discharge holes communicating the reception part supporting the support unit body and the discharge pipe with each other.

10. The laundry treating apparatus according to claim 1, further comprising:

a first sealing part to protrude from an outer circumferential surface of the input hole toward the input hole cover; and a second sealing part to protrude from the outer circumferential surface of the input hole cover toward the input hole, wherein the first sealing part and the second sealing part are combined to form a cylinder surrounding the outer circumferential surface of the input hole.

11. The laundry treating apparatus according to claim 10, wherein:

the first sealing part at a portion of the outer circumferential surface of the input hole located in a withdrawal direction of the drawer; and the second sealing part at a portion of the outer circumferential surface of the input hole cover located in the opposite direction to the withdrawal direction of the drawer.

12. The laundry treating apparatus according to claim 1, further comprising:

a pump attached to an outer surface of the drawer body;

a tub connection pipe to guide wash water from the tub body to the pump;

a drain pipe unit to guide wash water from the pump to outside of the cabinet; and a communication unit to selectively communicate the drain pipe unit with external air.

13. The laundry treating apparatus according to claim 12, further comprising:

a first frame rotatably attached to the cabinet, the first frame to guide the drain pipe unit to the communication unit;

a second frame rotatably attached to the drawer body, the second frame located below the first frame, and the second frame to guide the drain pipe unit to the pump; and a frame rotary shaft rotatably connecting the first frame and the second frame and separating the first frame and the second frame by a designated distance.

14. The laundry treating apparatus according to claim 13, further comprising:

a cabinet connection shaft to rotatably attach the first frame to the communication unit fixed to the cabinet; and a drawer rotary shaft to rotatably attach the second frame to the drawer body.

15. A laundry treating apparatus comprising:

a first treating apparatus to wash or dry laundry; and a second treating apparatus at the first treating apparatus, wherein the second treating apparatus includes:

a cabinet to provide an external appearance of the second treating apparatus, a drawer having a drawer body and an input hole provided at an upper surface of the drawer body, an input hole cover fixed to the cabinet to close the input hole when the drawer is within the cabinet, a tub at the drawer body, the tub having a tub body and a tub input hole provided at an upper surface of the tub body to communicate with the input hole, a detergent supply unit to store detergent, the detergent supply unit to be withdrawn from the drawer body toward a center of the input hole, channel communication parts formed through the upper surface of the drawer body and communicating with the detergent supply unit, channels provided on the input hole cover to supply water to the channel communication parts and detachably combined with the channel communication parts, and a water supply unit to supply wash water to the channels.

16. The laundry treating apparatus according to claim 15, wherein the drawer includes:

a support part to close a portion of the input hole; and a reception part on the support part, the reception part to receive the detergent supply unit, and the reception part to guide the detergent and wash water from the detergent supply unit to the tub body.

17. The laundry treating apparatus according to claim 16, wherein the detergent supply unit includes:

a supply unit body to withdraw from the reception part; and storage units at the supply unit body for receiving wash water from the channel communication parts.

18. The laundry treating apparatus according to claim 17, wherein the tub includes:

a door support part to close a portion of the tub input hole;

a door on the door support part to open and close the tub input hole; and an influx part on the door support part to allow the wash water and detergent from the reception part to be provided to the tub body.

* * * * *